US011602174B2

(12) United States Patent
Angell et al.

(10) Patent No.: US 11,602,174 B2
(45) Date of Patent: Mar. 14, 2023

(54) VAPOR PROVISION SYSTEMS

(71) Applicant: Nicoventures Holdings Limited, London (GB)

(72) Inventors: Terry Lee Angell, London (GB); Alexander Simpson, London (GB)

(73) Assignee: Nicoventures Trading Limited, London (GB)

( * ) Notice: Subject to any disclaimer, the term of this patent is extended or adjusted under 35 U.S.C. 154(b) by 363 days.

(21) Appl. No.: 16/641,790

(22) PCT Filed: Aug. 17, 2018

(86) PCT No.: PCT/GB2018/052343

§ 371 (c)(1),
(2) Date: Feb. 25, 2020

(87) PCT Pub. No.: WO2019/038521

PCT Pub. Date: Feb. 28, 2019

(65) Prior Publication Data

US 2021/0378306 A1 Dec. 9, 2021

(30) Foreign Application Priority Data

Aug. 25, 2017 (GB) ..... 1713681

(51) Int. Cl.

| | |
|---|---|
| ***A24F 40/46*** | (2020.01) |
| ***A24F 40/44*** | (2020.01) |
| ***A24F 40/53*** | (2020.01) |
| ***A24F 40/42*** | (2020.01) |
| *A24F 40/10* | (2020.01) |

(52) U.S. Cl.
CPC ..... *A24F 40/46* (2020.01); *A24F 40/42* (2020.01); *A24F 40/44* (2020.01); *A24F 40/53* (2020.01); *A24F 40/10* (2020.01)

(58) Field of Classification Search
None
See application file for complete search history.

(56) References Cited

U.S. PATENT DOCUMENTS

| | | | |
|---|---|---|---|
| 5,916,493 | A | 6/1999 | Miller |
| 6,131,570 | A | 10/2000 | Schuster et al. |

(Continued)

FOREIGN PATENT DOCUMENTS

| | | | |
|---|---|---|---|
| AU | 2018320481 | B2 | 3/2021 |
| BR | 102014028886 | A2 | 6/2016 |

(Continued)

OTHER PUBLICATIONS

Chen W., et al., "Measurement of Heating Coil Temperature for E-Cigarettes with a "Top-Coil" Clearomizer," Apr. 19, 2018, 16 pages.

(Continued)

*Primary Examiner* — James Harvey
(74) *Attorney, Agent, or Firm* — Patterson Thuente, P.A.

(57) ABSTRACT

The disclosure relates to a vaporizer assembly for use in a vapor provision system, wherein the vaporizer assembly includes a liquid transport element formed from cotton; and a heating element comprising a coil of resistive wire around a portion of the liquid transport element, wherein the heating element has an electrical resistance of between 1.3 ohms and 1.5 ohms.

22 Claims, 6 Drawing Sheets

(56) References Cited

U.S. PATENT DOCUMENTS

| | | | | |
|---|---|---|---|---|
| 6,325,475 | B1 | 12/2001 | Hayes et al. | |
| 9,210,738 | B2 * | 12/2015 | Ward | H05B 3/00 |
| 9,301,547 | B2 | 4/2016 | Liu | |
| 10,058,122 | B2 | 8/2018 | Steingraber et al. | |
| 10,070,662 | B2 * | 9/2018 | Gorilovsky | F04B 43/046 |
| 10,271,578 | B2 | 4/2019 | John et al. | |
| 11,432,589 | B2 | 9/2022 | Otiaba et al. | |
| 2001/0032647 | A1 | 10/2001 | Schuster et al. | |
| 2011/0047957 | A1 | 3/2011 | Richard | |
| 2012/0199146 | A1 | 8/2012 | Marangos | |
| 2013/0192618 | A1 | 8/2013 | Li et al. | |
| 2014/0014126 | A1 | 1/2014 | Peleg et al. | |
| 2014/0060555 | A1 | 3/2014 | Chang et al. | |
| 2014/0209105 | A1 * | 7/2014 | Sears | A24F 40/44 131/328 |
| 2014/0261487 | A1 | 9/2014 | Chapman et al. | |
| 2014/0366898 | A1 | 12/2014 | Monsees et al. | |
| 2015/0013702 | A1 * | 1/2015 | Liu | A24F 40/46 131/329 |
| 2015/0040925 | A1 | 2/2015 | Saleem et al. | |
| 2015/0053221 | A1 * | 2/2015 | Asghar-Sheikh | A24F 40/40 131/329 |
| 2015/0083147 | A1 | 3/2015 | Schiff et al. | |
| 2015/0164143 | A1 | 6/2015 | Maas | |
| 2015/0201674 | A1 * | 7/2015 | Dooly | B65B 5/06 131/328 |
| 2015/0223522 | A1 | 8/2015 | Ampolini et al. | |
| 2015/0237916 | A1 | 8/2015 | Farine et al. | |
| 2015/0296885 | A1 | 10/2015 | Liu | |
| 2016/0044963 | A1 | 2/2016 | Saleem | |
| 2017/0006917 | A1 * | 1/2017 | Alvarez | A24F 40/42 |
| 2017/0156400 | A1 | 6/2017 | Liu | |
| 2017/0172212 | A1 * | 6/2017 | Phillips | A24F 40/42 |
| 2018/0020732 | A1 | 1/2018 | Kozlowski et al. | |
| 2018/0043114 | A1 * | 2/2018 | Bowen | A61M 15/003 |
| 2018/0343926 | A1 | 12/2018 | Wensley | |
| 2019/0099561 | A1 * | 4/2019 | Nettenstrom | A61M 11/042 |
| 2019/0208826 | A1 | 7/2019 | John et al. | |
| 2019/0223508 | A1 | 7/2019 | Otiaba et al. | |
| 2021/0378306 | A1 * | 12/2021 | Angell | A24F 40/44 |

FOREIGN PATENT DOCUMENTS

| | | | |
|---|---|---|---|
| CN | 101557728 | B | 4/2011 |
| CN | 106333387 | A | 1/2017 |
| DE | 202014101126 | U1 | 4/2014 |
| EP | 2641490 | A1 | 9/2013 |
| EP | 2724630 | A1 | 4/2014 |
| EP | 2921065 | A1 | 9/2015 |
| EP | 3009018 | A1 | 4/2016 |
| EP | 3050446 | A1 | 8/2016 |
| EP | 3069620 | A1 | 9/2016 |
| EP | 3108759 | A1 | 12/2016 |
| EP | 3672433 | A1 | 7/2020 |
| JP | S61158177 | U | 10/1986 |
| JP | 2017510260 | A | 4/2017 |
| JP | 2019512225 | A | 5/2019 |
| JP | 2020530994 | A | 11/2020 |
| KR | 20160127781 | A | 11/2016 |
| RU | 2132629 | C1 | 7/1999 |
| WO | WO-2010078559 | A1 | 7/2010 |
| WO | WO-2011050964 | A1 | 5/2011 |
| WO | WO-2013116571 | A1 | 8/2013 |
| WO | WO-2013159245 | A1 | 10/2013 |
| WO | WO-2014147114 | A1 | 9/2014 |
| WO | WO-2015026948 | A1 | 2/2015 |
| WO | WO-2015071703 | A1 | 5/2015 |
| WO | WO-2015112750 | A1 | 7/2015 |
| WO | WO-2015117704 | A1 | 8/2015 |
| WO | WO-2015140012 | A1 | 9/2015 |
| WO | WO-2016014652 | A1 | 1/2016 |
| WO | WO-2016099276 | A1 | 6/2016 |
| WO | WO-2016108693 | A1 | 7/2016 |
| WO | WO-2016108694 | A1 | 7/2016 |
| WO | WO-2016122417 | A1 | 8/2016 |
| WO | WO-2016135331 | A1 | 9/2016 |
| WO | WO-2017037457 | A1 | 3/2017 |
| WO | WO-2017153579 | A1 | 9/2017 |
| WO | WO-2019038521 | A1 | 2/2019 |

OTHER PUBLICATIONS

Communication pursuant to Article 94(3) EPC for Application No. 18759708.3, dated Mar. 12, 2021, 4 pages.

Communication pursuant to Article 94(3) EPC for Application No. 18759709.1, dated Jul. 19, 2019, 5 pages.

Decision of Grant dated Dec. 19, 2019 and Search report for Russian Patent Application No. 2019123009, 12 pages.

Decision to Grant dated Sep. 18, 2020 for Russian Application No. 2020107622, 8 pages.

First Office Action and Search Report for Chinese Patent Application No. 201880054671.2, dated Jan. 7, 2022, 21 pages.

Gesamtkatalog Texgilles: "Gesamtkatalog 2015 Wir bewegen undkontrollieren Ihr Gam", Jan. 1, 2015, XP055522016,Retrieved from the Internet:URL:https://www.texgilles.de/download.php/105/Prospekt_Garnqualitat.pdf[retrieved on Nov. 7, 2018].

International Preliminary Report on Patentability for Application No. PCT/GB2018/052343, dated Aug. 12, 2019, 5 pages.

International Preliminary Report on Patentability for Application No. PCT/GB2018/052344, dated Mar. 5, 2020, 8 pages.

International Search Report and Written Opinion for Application No. PCT/GB2018/052343, dated Oct. 18, 2018, 9 pages.

International Search Report and Written Opinion for Application No. PCT/GB2018/052344, dated Nov. 21, 2018, 10 pages.

International Preliminary Report on Patentability for Application No. PCT/GB2018/050061, dated Jan. 8, 2019, 19 pages.

International Search Report and Written Opinion for Application No. PCT/GB2018/050061, dated Apr. 18, 2018, 19 pages.

Notice of Reason for Refusal for Japanese Application No. 2019-534366 dated Oct. 13, 2020, 5 pages.

Office Action and Examination Search Report for Canadian Patent Application No. 3,073,793, dated Nov. 24, 2021, 5 pages.

Office action and Search Report dated Jun. 9, 2020 for Russian Application No. 2020107622, filed Aug. 17, 2018, 8 pages.

Office Action and Search Report dated May 27, 2020 for Russian Application No. 2020107622, 8 pages.

Office action for Korean Application No. 10-2020-7005180, dated Jul. 1, 2022, 5 pages.

Search Report under Section 17(5) dated Feb. 15, 2018 for Great Britain Application No. 1713679.7, 3 pages.

Search Report under Section 17(5) dated Feb. 21, 2018 for Great Britain Application No. 1713681.3, 4 pages.

Toyota Textile Machinery Division, "Ring Spinning Frame," Jan. 1, 2016, XP055522013, Retrieved from the Internet: URL: http://toyotatextilemachinery.com/wp-content/uploads/2016/11/RX300_E_2016.pdf [retrieved on Nov. 7, 2018].

Zhao T., et al., "Effects of Design Parameters and Puff Topography on Heating Coil Temperature and Mainstream Aerosols in Electronic Cigarettes", Mar. 16, 2016, 9 pages.

* cited by examiner

VAPOR PROVISION SYSTEMS

PRIORITY CLAIM

The present application is a National Phase entry of PCT Application No. PCT/GB2018/052343, filed Aug. 17, 2018, which claims priority from GB Patent Application No. 1713681.3, filed Aug. 25, 2017, each of which is hereby fully incorporated herein by reference.

FIELD

The present disclosure relates to vapor provision systems such as nicotine delivery systems (e.g. electronic cigarettes and the like).

BACKGROUND

Electronic vapor provision systems such as electronic cigarettes (e-cigarettes) generally contain a vapor precursor material, such as a reservoir of a source liquid containing a formulation, typically including nicotine, from which a vapor is generated for inhalation by a user, for example through heat vaporization. Thus, a vapor provision system will typically comprise a vapor generation chamber containing a vaporizer assembly arranged to vaporize a portion of precursor material to generate a vapor in the vapor generation chamber. The vaporizer assembly will often comprise a heater coil arranged around a liquid transport element (capillary wick) that is arranged to transport source liquid from a reservoir to the heater coil for vaporization. As a user inhales on the device and electrical power is supplied to the vaporizer assembly, air is drawn into the device through an inlet hole and into the vapor generation chamber where the air mixes with vaporized precursor material to form a condensation aerosol. There is an air channel connecting the vapor generation chamber and an opening in the mouthpiece so the air drawn through the vapor generation chamber as a user inhales on the mouthpiece continues along the flow path to the mouthpiece opening, carrying the vapor with it for inhalation by the user.

The design of aspects relating to the vaporizer assembly of a vapor provision system can play an important role in the overall performance of the system, for example in terms of helping to reduce leakage, helping to provide a desired level of vapor generation, and helping to reduce the likelihood of overheating due to insufficiently fast replenishment of vaporized liquid, which can lead to undesirable flavors. Various approaches are described herein which seek to help address some of these issues.

SUMMARY

According to a first aspect of certain embodiments there is provided a vaporizer assembly for use in a vapor provision system, wherein the vaporizer assembly comprises: a liquid transport element formed from cotton; and a heating element comprising a coil of resistive wire around a portion of the liquid transport element, wherein the heating element has an electrical resistance of between 1.3 ohms and 1.5 ohms.

According to a second aspect of certain embodiments there is provided apparatus comprising the vaporizer assembly of the first aspect of certain embodiments and a reservoir for source liquid, wherein the liquid transport element is arranged to draw source liquid from the reservoir to the heating element for heating to generate vapor for user inhalation.

According to a third aspect of certain embodiments there is provided vaporizer assembly means for use in a vapor provision means, wherein the vaporizer assembly means comprises: liquid transport means formed from cotton; and heating element means comprising a coil of resistive wire around a portion of the liquid transport means, wherein the heating element means has an electrical resistance of between 1.3 ohms and 1.5 ohms.

According to a fourth aspect of certain embodiments there is provided a method of manufacturing a vaporizer assembly for use in a vapor provision system, wherein the method comprises: providing a liquid transport element; and forming a heating element comprising a coil of resistive wire around a portion of the liquid transport element, wherein the heating element has an electrical resistance of between 1.3 ohms and 1.5 ohms.

It will be appreciated that features and aspects described herein in relation to the various aspects of the disclosure are equally applicable to, and may be combined with, embodiments of the disclosure according to other aspects as appropriate, and not just in the specific combinations described herein.

BRIEF DESCRIPTION OF THE DRAWINGS

Embodiments of the disclosure will now be described, by way of example only, with reference to the accompanying drawings, in which.

DETAILED DESCRIPTION

Figure 1:
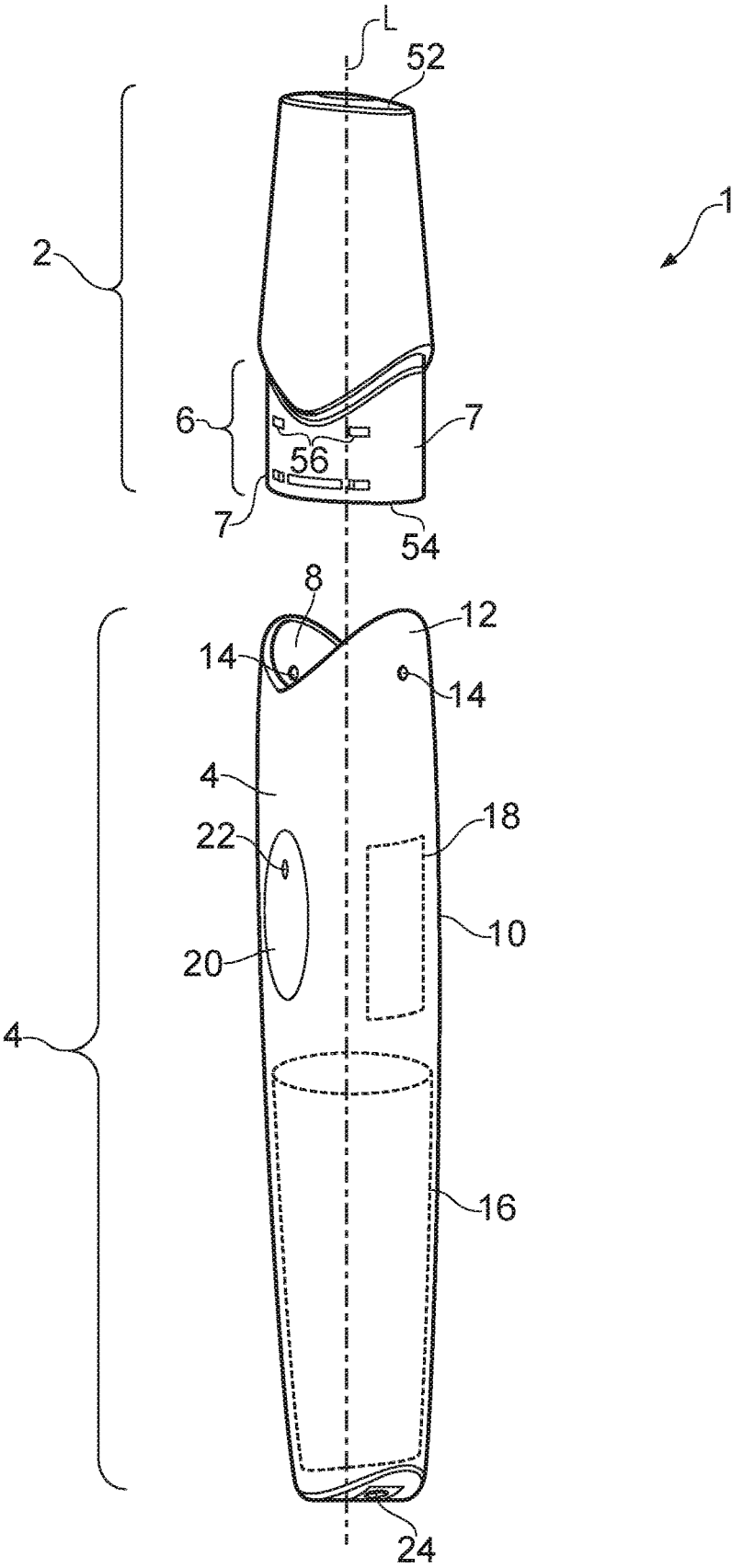
FIG. 1 schematically represents in perspective view a vapor provision system comprising a cartridge and control unit (shown separated) in accordance with certain embodiments of the disclosure.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to vapor provision systems, which may also be referred to as aerosol provision systems, such as e-cigarettes. Throughout the following description the term "e-cigarette" or "electronic cigarette" may sometimes be used, but it will be appreciated this term may be used interchangeably with vapor provision system/device and electronic vapor provision system/device. Furthermore, and as is common in the technical field, the terms "vapor" and "aerosol", and related terms such as "vaporize", "volatilize" and "aerosolize", may generally be used interchangeably.

Vapor provision systems (e-cigarettes) often, though not always, comprise a modular assembly including both a reusable part (control unit part) and a replaceable (disposable) cartridge part. Often the replaceable cartridge part will comprise the vapor precursor material and the vaporizer assembly and the reusable part will comprise the power supply (e.g. rechargeable battery) and control circuitry. It will be appreciated these different parts may comprise further elements depending on functionality. For example, the reusable device part may comprise a user interface for receiving user input and displaying operating status characteristics, and the replaceable cartridge part may comprise a temperature sensor for helping to control temperature. Cartridges are electrically and mechanically coupled to a control unit for use, for example using a screw thread, latching or bayonet fixing with appropriately engaging electrical contacts. When the vapor precursor material in a cartridge is exhausted, or the user wishes to switch to a different cartridge having a different vapor precursor material, a cartridge may be removed from the control unit and a replacement cartridge attached in its place. Devices conforming to this type of two-part modular configuration may generally be referred to as two-part devices. It is also common for electronic cigarettes to have a generally elongate shape. For the sake of providing a concrete example, certain embodiments of the disclosure described herein will be taken to comprise this kind of generally elongate two-part device employing disposable cartridges. However, it will be appreciated the underlying principles described herein may equally be adopted for different electronic cigarette configurations, for example single-part devices or modular devices comprising more than two parts, refillable devices and single-use disposable devices, as well as devices conforming to other overall shapes, for example based on so-called box-mod high performance devices that typically have a more box-like shape. More generally, it will be appreciated certain embodiments of the disclosure are based on approaches for seeking to help optimize vaporizer assembly performance in vapor delivery systems in accordance with the principles described herein, and other constructional and functional aspects of electronic cigarettes implementing approaches in accordance with certain embodiments of the disclosure are not of primary significance and may, for example, be implemented in accordance with any established approaches.

FIG. 1 is a schematic perspective view of an example vapor provision system/device (e-cigarette) 1 in accordance with certain embodiments of the disclosure. Positional terms concerning the relative location of various aspects of the electronic cigarette (e.g. terms such as upper, lower, above, below, top, bottom, etc.) may be used herein with reference to the orientation of the electronic cigarette as shown in FIG. 1 (unless the context indicates otherwise). However, it will be appreciated this is purely for ease of explanation and is not intended to indicate there is any required orientation for the electronic cigarette in use.

The e-cigarette 1 comprises two main components, namely a cartridge 2 and a control unit 4. The control unit 4 and the cartridge 2 are shown separated in FIG. 1, but are coupled together when in use.

The cartridge 2 and control unit 4 are coupled by establishing a mechanical and electrical connection between them. The specific manner in which the mechanical and electrical connection is established is not of primary significance to the principles described herein and may be established in accordance with conventional techniques, for example based around a screw thread, bayonet, latched or friction-fit mechanical fixing with appropriately arranged electrical contacts/electrodes for establishing the electrical connection between the two parts as appropriate. For the example electronic cigarette 1 represented in FIG. 1, the cartridge comprises a mouthpiece end 52 and an interface end 54 and is coupled to the control unit by inserting an interface end portion 6 at the interface end of the cartridge into a corresponding receptacle 8/receiving section of the control unit. The interface end portion 6 of the cartridge is a close fit to be receptacle 8 and includes protrusions 56 which engage with corresponding detents in the interior surface of a receptacle wall 12 defining the receptacle 8 to provide a releasable mechanical engagement between the cartridge and the control unit. An electrical connection is established between the control unit and the cartridge via a pair of electrical contacts on the bottom of the cartridge (not shown in FIG. 1) and corresponding sprung contact pins in the base of the receptacle 8 (not shown in FIG. 1). As noted above, the specific manner in which the electrical connection is established is not significant to the principles described herein, and indeed some implementations might not have an electrical connection between the cartridge and a control unit at all, for example because the transfer of electrical power from the reusable part to the cartridge may be wireless (e.g. based on electromagnetic induction techniques).

The electronic cigarette 1 has a generally elongate shape extending along a longitudinal axis L. When the cartridge is coupled to the control unit, the overall length of the electronic cigarette in this example (along the longitudinal axis) is around 12.5 cm. The overall length of the control unit is around 9 cm and the overall length of the cartridge is around 5 cm (i.e. there is around 1.5 cm of overlap between the interface end portion 6 of the cartridge and the receptacle 8 of the control unit when they are coupled together). The electronic cigarette has a cross-section which is generally oval and which is largest around the middle of the electronic cigarette and tapers in a curved manner towards the ends. The cross-section around the middle of the electronic cigarette has a width of around 2.5 cm and a thickness of around 1.7 cm. The end of the cartridge has a width of around 2 cm and a thickness of around 0.6 mm, whereas the other end of the electronic cigarette has a width of around 2 cm and a thickness of around 1.2 cm. The outer housing of the electronic cigarette is in this example formed from plastic. It will be appreciated the specific size and shape of the electronic cigarette and the material from which it is made is not of primary significance to the principles described herein and may be different in different implementations. That is to say, the principles described herein may equally be adopted for electronic cigarettes having different sizes, shapes and/or materials.

The control unit 4 may in accordance with certain embodiments of the disclosure be broadly conventional in terms of its functionality and general construction techniques. In the example of FIG. 1, the control unit 4 comprises a plastic outer housing 10 including the receptacle wall 12 that defines the receptacle 8 for receiving the end of the cartridge as noted above. The outer housing 10 of the control unit 4 in this example has a generally oval cross section conforming to the shape and size of the cartridge 2 at their interface to provide a smooth transition between the two parts. The receptacle 8 and the end portion 6 of the cartridge 2 are symmetric when rotated through 180° so the cartridge can be inserted into the control unit in two different orientations. It will be appreciated some implementations may not have any degree of rotational symmetry such that the cartridge is couplable to the control unit in only one orientation while other implementations may have a higher degree of rotational symmetry such that the cartridge is couplable to the control unit in more orientations. The receptacle wall 12 includes two control unit air inlet openings 14 (i.e. holes in the wall). In use, when a user inhales on the device, air is drawn in through these holes and along respective gaps between the cartridge part 2 and the receptacle wall 12 provided by flat portions 7 on the cartridge part towards the interface end of the cartridge part 54 where the air enters the cartridge through an opening in the base end of the cartridge (the air inlet to the cartridge is not seen in FIG. 1). It will be appreciated that even away from the flat portions 7, the interface end portion 6 of the cartridge 2 does not form an airtight seal with the receptacle wall 12 so some air drawn may also be drawn into the cartridge through gaps between the cartridge and the control unit 4.

The control unit further comprises a battery 16 for providing operating power for the electronic cigarette, control circuitry 18 for controlling and monitoring the operation of the electronic cigarette, a user input button 20, an indicator light 22, and a charging port 24.

The battery 16 in this example is rechargeable and may be of a conventional type, for example of the kind normally used in electronic cigarettes and other applications requiring provision of relatively high currents over relatively short periods. The battery 16 may be recharged through the charging port 24, which may, for example, comprise a USB connector.

The input button 20 in this example is a conventional mechanical button, for example comprising a sprung mounted component which may be pressed by a user to establish an electrical contact in underlying circuitry. In this regard, the input button may be considered an input device for detecting user input, e.g. to trigger vapor generation, and the specific manner in which the button is implemented is not significant. For example, other forms of mechanical button or touch-sensitive button (e.g. based on capacitive or optical sensing techniques) may be used in other implementations, or there may be no button and the device may rely on a puff detector for triggering vapor generation.

The indicator light 22 is provided to give a user with a visual indication of various characteristics associated with the electronic cigarette, for example, an indication of an operating state (e.g. on/off/standby), and other characteristics, such as battery life or fault conditions. Different characteristics may, for example, be indicated through different colors and/or different flash sequences in accordance with generally conventional techniques.

The control circuitry 18 is suitably configured/programmed to control the operation of the electronic cigarette to provide conventional operating functions in line with the established techniques for controlling electronic cigarettes. The control circuitry (processor circuitry) 18 may be considered to logically comprise various sub-units/circuitry elements associated with different aspects of the electronic cigarette's operation. For example, depending on the functionality provided in different implementations, the control circuitry 18 may comprises power supply control circuitry for controlling the supply of power from the battery to the cartridge in response to user input, user programming circuitry for establishing configuration settings (e.g. user-defined power settings) in response to user input, as well as other functional units/circuitry associated functionality in accordance with the principles described herein and conventional operating aspects of electronic cigarettes, such as indicator light display driving circuitry and user input detection circuitry. It will be appreciated the functionality of the control circuitry 18 can be provided in various different ways, for example using one or more suitably programmed programmable computer(s) and/or one or more suitably configured application-specific integrated circuit(s)/circuitry/chip(s)/chipset(s) configured to provide the desired functionality.

Figure 2:
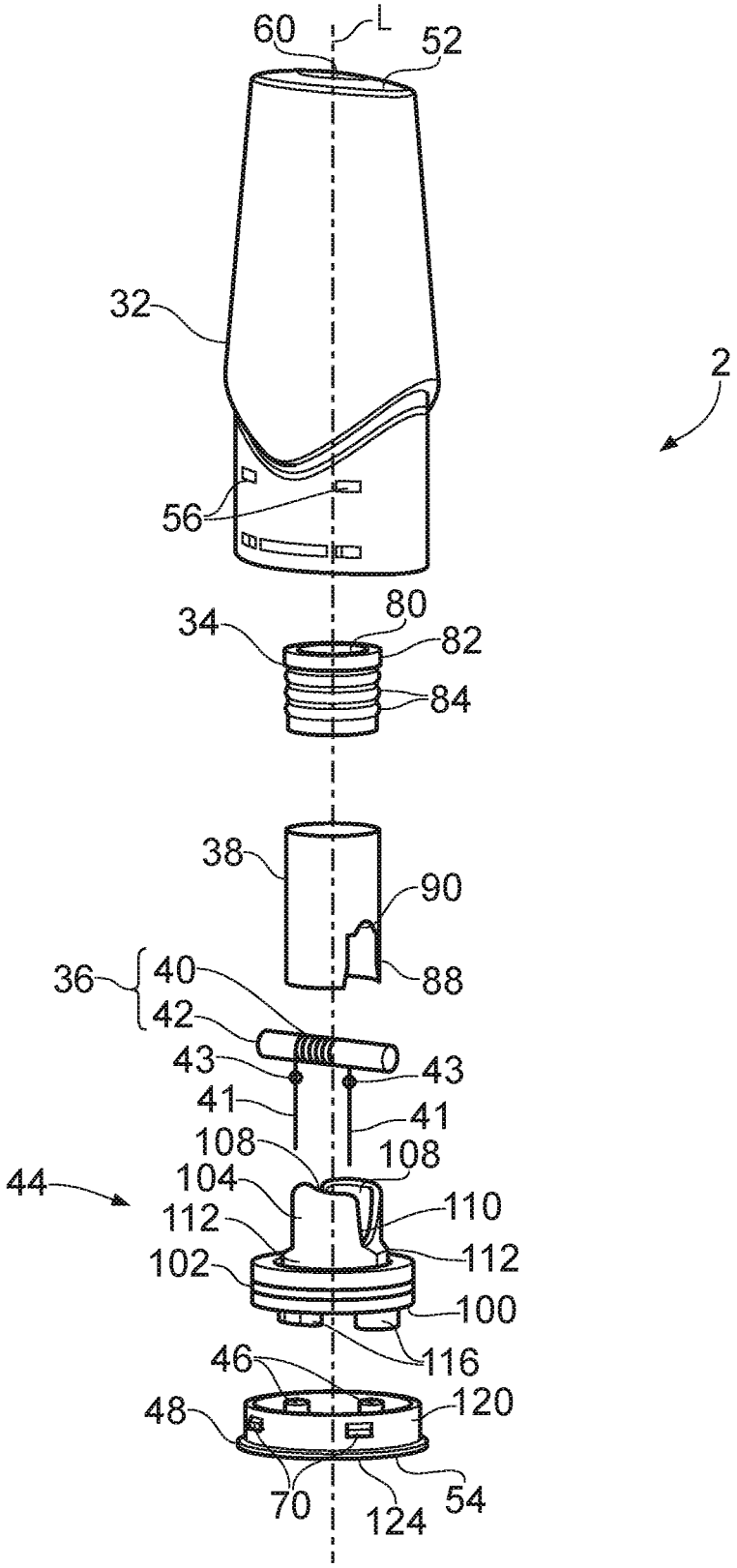
FIG. 2 schematically represents in exploded perspective view of components of the cartridge of the vapor provision system of FIG. 1.

FIG. 2 is an exploded schematic perspective view of the cartridge 2 (exploded along the longitudinal axis L). The cartridge 2 comprises a housing part 32, an air channel seal 34, an outlet tube 38, a vaporizer assembly 36 comprising a heater 40 and a liquid transport element 42, a resilient plug 44, and an end cap 48 with contact electrodes 46.

Figure 3A:
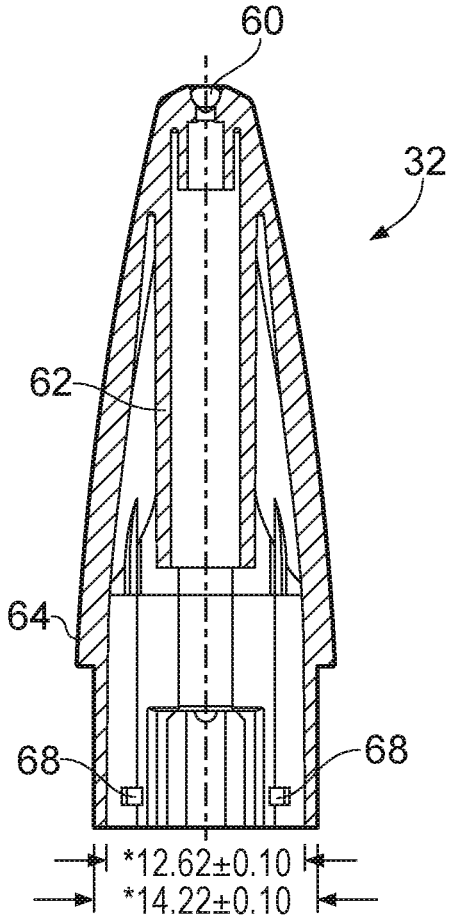
FIGS. 3A to 3C schematically represent various cross-section views of a housing part of the cartridge of the vapor provision system of FIG. 1.
Figure 3B:
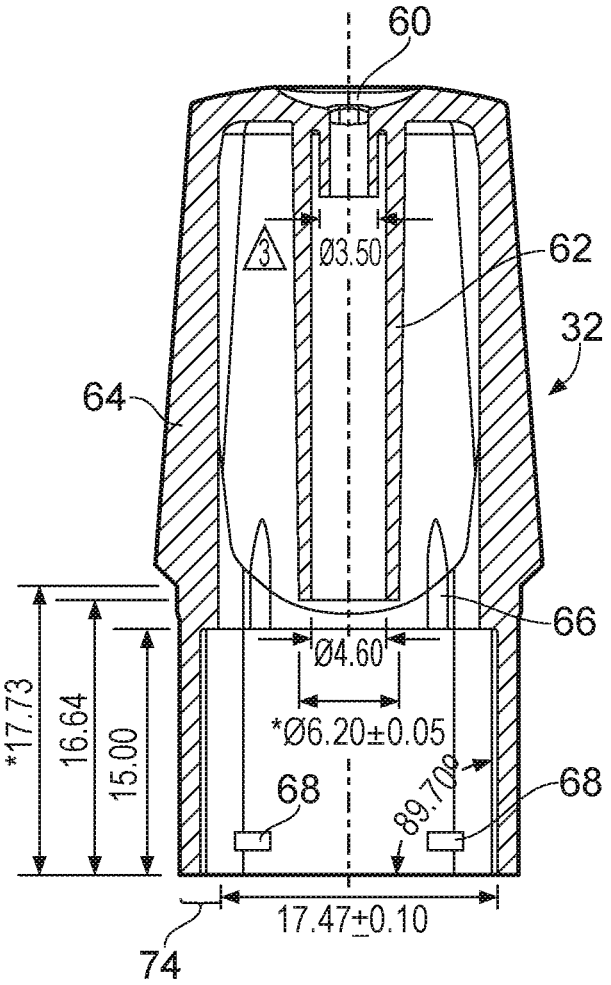
Figure 3C:
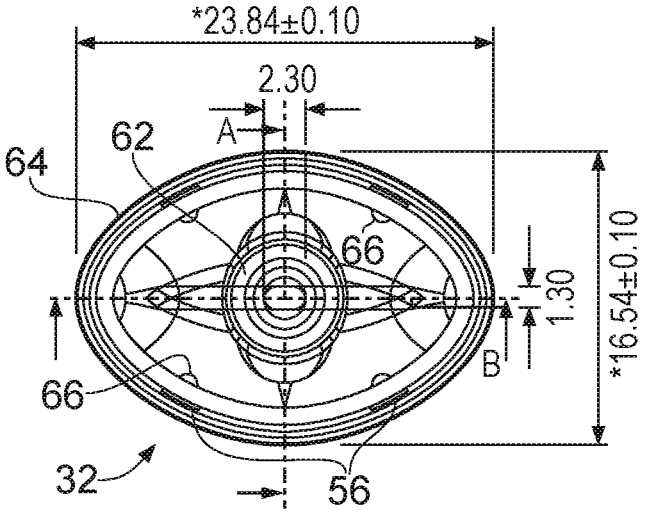

FIG. 3A is a schematic cut-away view of the housing part 32 through the longitudinal axis L where the housing part 32 is thinnest. FIG. 3B is a schematic cut-away view of the housing part 32 through the longitudinal axis L where the housing part 32 is widest. FIG. 3C is a schematic view of the housing part along the longitudinal axis L from the interface end 54 (i.e. viewed from below in the orientation of FIGS. 3A and 3B).

The housing part 32 in this example comprises a housing outer wall 64 and a housing inner tube 62 which in this example are formed from a single molding of polypropylene. The housing outer wall 64 defines the external appearance of the cartridge 2 and the housing inner tube 62 defines a part the air channel through the cartridge. The housing part is open at the interface end 54 of the cartridge and closed at the mouthpiece end 52 of the cartridge except for a mouthpiece opening/vapor outlet 60 in fluid communication with the housing inner tube 62. The outer wall 64 of the housing part 32 comprises holes which provide latch recesses 68 arranged to receive corresponding latch projections 70 in the end cap 48 to fix the end cap to be housing part when the cartridge is assembled.

The air channel seal 34 is a silicone molding generally in the form of a tube having a through hole 80. The outer wall of the air channel seal 34 includes circumferential ridges 84 and an upper collar 82. The inner wall of the air channel seal 34 also includes circumferential ridges, but these are not visible in FIG. 2. When the cartridge is assembled the air channel seal 34 is mounted to the housing inner tube 62 with an end of the housing inner tube 62 extending partly into the through hole 80 of the air channel seal 34. The through hole 80 in the air channel seal has a diameter of around 5.8 mm in its relaxed state whereas the end of the housing inner tube 62 has a diameter of around 6.2 mm so that a seal is formed when the air channel seal 34 is stretched to accommodate the housing inner tube 62. This seal is facilitated by the ridges on the inner surface of the air channel seal 34.

The outlet tube 38 comprises a tubular section of ANSI 304 stainless steel with an internal diameter of around 8.6 mm and a wall thickness of around 0.2 mm. The bottom end of the outlet tube 38 includes a pair of diametrically opposing slots 88 with an end of each slot having a semi-circular recess 90. When the cartridge is assembled the outlet tube 38 mounts to the outer surface of the air channel seal 34. The outer diameter of the air channel seal is around 9.0 mm in its relaxed state so that a seal is formed when the air channel seal 34 is compressed to fit inside the outlet tube 38. This seal is facilitated by the ridges 84 on the outer surface of the air channel seal 34. The collar 80 on the air channel seal 34 provides a stop for the outlet tube 38.

The liquid transport element 42 comprises a capillary wick and the heater 40 comprises a resistance wire wound around the capillary wick.

In addition to the portion of the resistance wire wound around the capillary wick 42 to provide the heater 40, the vaporizer assembly 36 further comprises electrical leads 41 which pass through holes in the resilient plug 44 to contact electrodes 46 mounted to the end cap 54 to allow power to be supplied to the heater 40 via the electrical interface established when the cartridge is connected to a control unit. The heater leads 41 may comprise the same material as the resistance wire wound around the capillary wick forming the heater 40, but in this example the heater leads 41 comprise a different material (a lower-resistance material) connected to the heater resistance wire wound around the capillary wick. In this example the heater 40 comprises a coil of nickel chrome (NiChrome) alloy wire, the wick 42 comprises organic cotton, and the heater leads 41 comprise N6 Nickel wire soldered to respective ends of the heater coil 40 at solder junctions 43. Some further aspects and features of vaporizer assemblies according to different embodiments of the disclosure are described further below.

When the cartridge is assembled, the wick 42 is received in the semi-circular recesses 90 of the outlet tube 38 so that a central portion of the wick about which the heating coil is wound is inside the outlet tube while end portions of the wick are outside the outlet tube 38.

The resilient plug 44 in this example comprises a single molding of silicone. The resilient plug comprises a base part 100 having an outer wall 102 and an inner wall 104 extending upwardly from the base part 100 and surrounding a central through hole (not visible in FIG. 2) through the base part 100. When the cartridge is assembled and in use, air entering the cartridge through an opening in the end cap 54 is drawn through the central through hole in the resilient plug 44 and into the vicinity of the heater 40 of the vaporizer assembly 36.

The outer wall 102 of the resilient plug 44 conforms to an inner surface of the housing part 32 so that when the cartridge is assembled the resilient plug in 44 forms a seal with the housing part 32. The inner wall 104 of the resilient plug 44 conforms to an inner surface of the outlet tube 38 so that when the cartridge is assembled the resilient plug 44 also forms a seal with the outlet tube 38. The inner wall 104 includes a pair of diametrically opposing slots 108 with the end of each slot having a semi-circular recess 110. Extended outwardly (i.e. in a direction away from the longitudinal axis of the cartridge) from the bottom of each slot in the inner wall 104 is a cradle section 112 shaped to receive a section of the liquid transport element 42 when the cartridge is assembled. The slots 108 and semi-circular recesses 110 provided by the inner wall of the resilient plug 44 and the slots 88 and semi-circular recesses 90 of the outlet tube 38 are aligned so that the slots 88 in the outlet tube 38 accommodate respective ones of the cradles 112 with the respective semi-circular recesses in the outlet tube and resilient plug cooperating to define holes through which the liquid transport element 42 passes. The size of the holes provided by the semi-circular recesses through which the liquid transport element passes correspond closely to the size and shape of the liquid transport element, but are slightly smaller so a degree of compression is provided by the resilience of the resilient plug 44. This allows liquid to be transported along the liquid transport element by capillary action while restricting the extent to which liquid which is not transported by capillary action can pass through the openings. As noted above, the resilient plug 44 further includes openings in the base part 100 through which the contact leads 41 for the heater coil 40 pass when the cartridge is assembled. In this example, the bottom of the base part of the resilient plug includes spacers 116 which maintain an offset between the remaining surface of the bottom of the base part and the end cap 48. These spacers 116 include the openings through which the electrical contact leads 41 for the heater coil pass.

The end cap 48 comprises a polypropylene molding with a pair of gold-plated copper electrode posts 46 mounted therein.

The ends of the electrode posts 46 on the bottom side of the end cap are close to flush with the interface end 54 of the cartridge provided by the end cap 48. These are the parts of the electrodes to which correspondingly aligned sprung contacts in the control unit connect when the cartridge is assembled and connected to the control unit. The ends of the electrode posts on the inside of the cartridge extend away from the end cap 48 and into the holes in the resilient plug 44 through which the contact leads 41 pass. The electrode posts are slightly oversized relative to the holes and include a chamfer at their upper ends to facilitate insertion into the holes in the resilient plug 44 where they are maintained in pressed contact with the contact leads 41 for the heater 40 by virtue of the resilient nature of the resilient plug.

The end cap has a base section 124 and an upstanding wall 120 which conforms to the inner surface of the housing part 32. The upstanding wall 120 of the end cap 48 is inserted into the housing part 32 so the latch projections 70 engage with the latch recesses 68 in the housing part 32 to snap-fit the end cap 48 to the housing part when the cartridge is assembled. The top of the upstanding wall 120 of the end cap 48 abuts a peripheral part of the resilient plug 44 and the lower face of the spacers 116 on the resilient plug also abut the base section 124 of the resilient plug so that when the end cap 48 is attached to the housing part it presses against the resilient part 44 to maintain it in slight compression.

The base portion 124 of the end cap 48 includes a peripheral lip beyond the base of the upstanding wall 112 with a thickness which corresponds with the thickness of the outer wall of the housing part at the interface end of the cartridge.

When the cartridge is assembled an air channel extending from the air inlet in the end cap 54 to the vapor outlet 60 through the cartridge is formed. Starting from the air inlet in the end cap, a first portion of the air channel is provided by the central hole through the resilient plug 44. A second portion of the air channel is provided by the region within the inner wall 104 of the resilient plug 44 and the outlet tube 38 around the heater 40. This second portion of the air channel may also be referred to as a vapor generation region, it being the primary region in which vapor is generated during use. The air channel from the air inlet in the base of the end cap 54 to the vapor generation region may be referred to as an air inlet section of the air channel. A third portion of the air channel is provided by the remainder of the outlet tube 38. A fourth portion of the air channel is provided by the outer housing inner tube 62 which connects the air channel to the vapor outlet 60. The air channel from the vapor generation region to be the vapor outlet may be referred to as a vapor outlet section of the air channel.

When the cartridge is assembled a reservoir for liquid is formed by the space outside the air channel and inside the housing part 32. This may be filled during manufacture, for example through a filling hole which is then sealed, or by other means. The specific nature of the liquid, for example in terms of its composition, is not of primary significance to the principles described herein, and in general any conventional liquid of the type normally used in electronic cigarettes may be used. The reservoir is closed at the interface end of the cartridge by the resilient plug 44. The liquid transport element (capillary wick) 42 of the vaporizer assembly 36 passes through openings in the wall of the air channel provided by the semi-circular recesses 110, 90 in the resilient plug 44 and the outlet tube 38, and the cradle sections 112 in the resilient plug 44 that engage with one another as discussed above. Thus, the ends of the liquid transport element 42 extend into the reservoir from which they draw liquid through the openings in the air channel to the heater 40 for subsequent vaporization.

In normal use, the cartridge 2 is coupled to the control unit 4 and the control unit activated to supply power to the cartridge via the contact electrodes 46 in the end cap 48. Power then passes through the connection leads 41 to the heater 40. The heater is thus electrically heated and so vaporizes a portion of the liquid from the liquid transport element in the vicinity of the heater. This generates vapor in the vapor generation region of the air path. Liquid that is vaporized from the liquid transport element is replaced by more liquid drawn from the reservoir by capillary action. While the heater is activated and a user inhales on the mouthpiece end 52 of the cartridge, air is drawn into the cartridge through the air inlet in the end cap 54 and into the vapor generation region surrounding the heater 40 through the hole in the base part 100 of the resilient plug 44. The incoming air mixes with vapor generated from the heater to form a condensation aerosol, which is then drawn along the outlet tube 38 and the housing part inner 62 before exiting through the mouthpiece outlet/vapor outlet 60 for user inhalation. In some example implementations, the air channel from the air inlet to the vapor outlet may have its smallest cross-sectional area where it passes through the hole in the resilient plug. That is to say, the hole in the resilient plug may be primarily responsible for governing the overall resistance to draw for the electronic cigarette.

As noted above, in accordance with certain embodiments of the disclosure the liquid transport element 42 may comprise cotton, e.g. Japanese cotton. While it is known for cotton to be used as a wicking material in vapor provision systems, the inventors have recognized new approaches doing this can in some scenarios improve performance. For example, a known approach for providing a cotton wick for an electronic cigarette is to cut strips from a flat sheet of cotton and to roll the strips of cotton to form wick element which is fed along the axis of a preformed heater coil. However, the inventors have found improved performance can be provided in various ways, for example by providing a wick comprising two or more twisted cotton threads, as opposed to a rolled strip of cotton, and/or wrapping the heater wire around a wick to form a heater coil that compresses the wick, as opposed to inserting a wick in a preformed coil, and/or selecting an appropriate heater coil resistance to complement a cotton wick. Aspects and features of these various new approaches are described further below.

Figure 4:
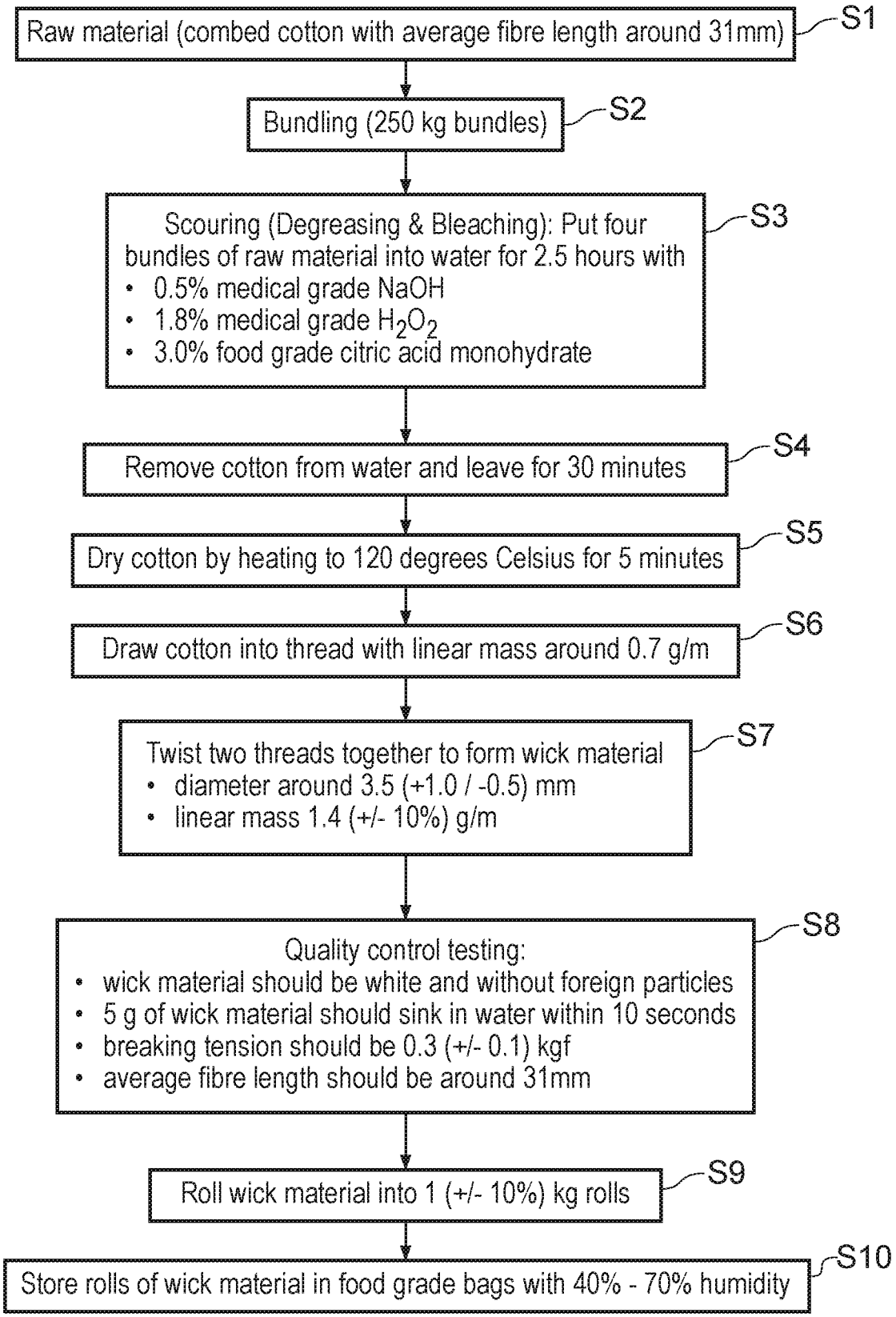
FIG. 4 is a flow diagram schematically representing steps in a method of forming material for use as a liquid transport element in a vapor provision system according to an embodiment of the disclosure.

FIG. 4 is flow diagram schematically representing a method for forming material for use as a liquid transport element (i.e. wick material) in a vaporizer assembly of a vapor provision system in accordance with certain embodiments of the disclosure, for example the vaporizer assembly 36 discussed above.

In S1 raw material for the wick material is provided. In this example the raw material comprises combed cotton, for example medical grade organic cotton, which may, for example, be Japanese cotton. The cotton may have relatively long fiber lengths, for example an average fiber length of around 31 mm. It will be appreciated this is merely one example specific material and average fiber length for one specific implementation, and in other examples the raw material may comprise a different form of cotton and/or have a different average fiber length, for example an average fiber length of more than around 15 mm, e.g. more than around 20 mm, e.g. more than around 25 mm, e.g. more than around 30 mm.

In S2 the raw material is formed into bundles having a mass of around 250 kg. It will be appreciated this is merely one example bundle size for one specific implementation, and in other examples the raw material may be bundled into bundles of different mass, for example a bundle mass of be more than around 100 kg, e.g. more than around 150 kg, e.g. more than around 200 kg and/or the bundle mass may be less than around 400 kg, e.g. less than around 350 kg, e.g. less than around 300 kg. More generally, it will be appreciated the specific size of the bundles may be selected according to the capacity of the processing line being used and the amount of wick material desired.

In S3 the bundles of raw material are scoured (decreased and bleached). This is done by putting four bundles of raw material (i.e. around one ton) in a scouring vessel containing water (scouring liquid) and around 0.5% (e.g. by weight) medical grade NaOH, around 1.8% (e.g. by weight) medical grade $H_2O_2$, and around 3.0% (e.g. by weight) food grade citric acid monohydrate for around 2.5 hours. It will be appreciated these parameters are merely examples for one specific implementation, and in other implementations different parameters may be used. For example, in some cases the scouring process may be applied to batches of more or fewer bundles, for example having regard to the capacity of the scouring vessel and the amount of wick material desired.

Furthermore, the amount of time the raw material spends in the scouring liquid may be different in different cases. For example, more generally the amount of time spent in the scouring liquid may be more than around 1 hour, e.g. more than around 1.5 hours, e.g. more than around 2 hours and/or the amount of time spent in the scouring liquid may be less than around 4 hours, e.g. less than around 3.5 hours, e.g. less than around 3 hours.

Also, the specific composition of the scouring liquid may be different in different implementations.

For example, in some cases the scouring liquid may comprise NaOH in a different proportion, e.g. an amount by weight of more than around 0.1%, e.g. more than around 0.2%, e.g. more than around 0.3%, e.g. more than around 0.4% and/or an amount by weight of less than around 1%, e.g. less than around 0.9%, e.g. less than around 0.8%, e.g. less than around 0.7%, e.g. less than around 0.6%. Furthermore, the scouring liquid may instead, or in addition, comprise a chemically suitable alternative for NaOH, such as another base/alkali hydroxide.

Similarly, in some cases the scouring liquid may comprise $H_2O_2$ in a different proportion, e.g. an amount by weight of more than around 0.5%, e.g. more than around 0.7%, e.g. more than around 0.9%, e.g. more than around 1.1%, e.g. more than around 1.3%, e.g. more than around 1.5% and/or an amount by weight of less than around 3%, e.g. less than around 2.8%, e.g. less than around 2.6%, e.g. less than around 2.4%, e.g. less than around 2.2%, e.g. less than around 2.0%. Furthermore, the scouring liquid may instead, or in addition, comprise a chemically suitable alternative, such as another oxidizer/bleaching agent.

Furthermore, in some cases the scouring liquid may comprise citric acid monohydrate in a different proportion, e.g. an amount by weight of more than around 1%, e.g. more than around 1.5%, e.g. more than around 2.0%, e.g. more than around 2.5% and/or an amount by weight of less than around 5%, e.g. less than around 4.5%, e.g. less than around 4%, e.g. less than around 3.5%. Furthermore still, the scouring liquid may instead, or in addition, comprise a chemically suitable alternative.

In S4 the bundles of scoured raw material are removed from the scouring vessel and allowed to rest (drain) for around 30 minutes. It will be appreciated this is merely one example rest duration for one specific implementation, and in other examples the scoured bundles may be left for a longer or shorter rest duration. For example, more generally the rest duration may be more than around 10 minutes, e.g. more than around 15 minutes, e.g. more than around 20 minutes, e.g. more than around 25 minutes and/or the rest duration may be less than around 60 minutes, e.g. less than around 50 minutes, e.g. less than around 45 minutes, e.g. less than around 40 minutes, e.g. less than around 35 minutes.

In S5 the bundles of scoured raw material are heated to around 120 degrees Celsius for around 5 minutes for drying. It will be appreciated these parameters are merely examples for one specific implementation, and in other implementations different parameters may be used. For example, more generally, the drying time in S5 may be more than around 1 minute, e.g. more than around 2 minutes, e.g. more than around 3 minutes, e.g. more than around 4 minutes and/or the drying time in S5 may be less than around 20 minutes, e.g. less than around 15 minutes, e.g. less than around 10 minutes, e.g. less than around 9 minutes, e.g. less than around 8 minutes, e.g. less than around 7 minutes, e.g. less than around 6 minutes. Furthermore, more generally, the drying temperature in S5 may be more than around 90 degrees Celsius, e.g. more than around 95 degrees Celsius, e.g. more than around 100 degrees Celsius, e.g. more than around 105 degrees, Celsius e.g. more than around 110 degrees Celsius, e.g. more than around 115 degrees Celsius and/or the drying temperature in S5 may be less than around 150 degrees Celsius, e.g. less than around 145 degrees Celsius, e.g. less than around 140 degrees Celsius, e.g. less than around 135 degrees Celsius, e.g. less than around 130 degrees Celsius, e.g. less than around 125 degrees Celsius.

In S6 the dried cotton is drawn into cotton thread with a linear mass (mass per length) of around 0.7 g/m and a cross section area of around 5 $mm^2$. This may be performed using conventional cotton thread drawing techniques, for example using an appropriately configured drawing frame. It will be appreciated this is merely one example thread linear mass and cross-sectional area for one specific implementation. In other examples the cotton may be drawn to form a thread with a different linear mass and/or different cross-sectional area. For example, in some cases the thread may have a thread linear mass of more than around 0.3 g/m, e.g. more than around 0.4 g/m, e.g. more than around 0.5 g/m, e.g. more than around 0.6 g/m and/or a thread linear mass of less than around 1.2 g/m, e.g. less than around 1.1 g/m, e.g. less than around 1.0 g/m, e.g. less than around 0.9 g/m, e.g. less than around 0.8 g/m. Furthermore, in some examples the thread may have a cross sectional area of more than around 1 $mm^2$, e.g. more than around 2 $mm^2$, e.g. more than around 3 $mm^2$, e.g. more than around 4 $mm^2$, and/or the thread may have a cross sectional area of less than around 9 $mm^2$, e.g. less than around 8 $mm^2$, e.g. less than around 7 $mm^2$, e.g. less than around 6 $mm^2$.

In S7 two cotton threads are twisted together to form the wick material. In this example the two threads are twisted relatively loosely, i.e. with a relatively long twist length, for example with around 22 twists per meter (i.e. an average pitch of around 4.5 cm for each thread). In other examples the threads may be twisted to form wick material with a different number of turns/twists per meter. For example, in some cases the number of twists per meter may be more than around 10, e.g. more than around 12, e.g. more than around 14, e.g. more than around 16, e.g. more than around 18, e.g. more than around 20, and/or the number of twists per meter may be less than around 34, e.g. less than around 32, e.g. less than around 30, e.g. less than around 28, e.g. less than around 26, e.g. less than around 24. Furthermore, whereas in this example the wick material consists of two twisted cotton threads, in other examples there may be more than two twisted cotton threads, for example three twisted cotton threads, four twisted cotton threads, five twisted cotton threads, or more twisted cotton threads. In any event, S7 may be performed using conventional cotton thread twisting techniques, for example using an appropriately configured thread twisting machine. The two cotton threads are twisted together in this example so that the resulting wick material has a linear mass of around 1.4 (+/−10%) g/m and a characteristic diameter of around 3.5 (+1.0/−0.5) mm.

It will be appreciated the wick material will in general not have a strictly circular cross-section, and in that regard, the characteristic diameter of the wick material may be taken to correspond to the diameter of a circle having the same cross-sectional area as the wick in a plane perpendicular to its length (i.e. characteristic diameter=2*sqrt(cross-sectional area/pi)). It will also be appreciated the characteristic diameter of the wick material will most likely vary to some extent along the length of the wick material, and in that sense the characteristic diameter may be considered to be a length-averaged characteristic diameter (e.g. averaged over a length is greater than the expected scale of typical variations in diameter, for example over two or three centimeters). Thus, while the term diameter may be used herein for simplicity, it will be appreciated this should be interpreted (both in relation to the wick material and threads comprising the wick material) as a reference to a length-averaged characteristic diameter. For example, a diameter corresponding to that of a circle having the same length-average cross-sectional area of the wick material, e.g. averaged over the typical length of a wick in a vaporizer assembly comprising the wick material, for example, averaged over around 1 cm, 2 cm, 3 cm, or more. In that sense the diameter of a section of uncompressed wick material may in some respects be characterized as the diameter of a cylinder having the same length and volume as the uncompressed wick material, and likewise for a section of compressed wick material.

It will be appreciated the values for the wick material linear mass and characteristic diameter are examples of one specific implementation. In other examples the cotton threads may be twisted together to form wick material with a different linear mass and characteristic diameter. For example in some cases the wick material may have a linear mass of more than around 0.5 g/m, e.g. more than around 0.6 g/m, e.g. more than around 0.7 g/m, e.g. more than around 0.8 g/m, e.g. more than around 0.9 g/m, e.g. more than around 1.0 g/m, e.g. more than around 1.1 g/m, e.g. more than around 1.2 g/m, e.g. more than around 1.3 g/m and/or the wick material may have a linear mass of less than around 2.5 g/m, e.g. less than around 2.4 g/m, e.g. less than around 2.3 g/m, e.g. less than around 2.2 g/m, e.g. less than around 2.1 g/m, e.g. less than around 2.0 g/m, e.g. less than around 1.9 g/m, e.g. less than around 1.8 g/m, e.g. less than around 1.7 g/m, e.g. less than around 1.6 g/m, e.g. less than around 1.5 g/m. Furthermore, in some cases the wick material may have a characteristic diameter of more than around 2.7 mm, e.g. more than around 2.8 mm, e.g. more than around 2.9 mm, e.g. more than around 3.0 mm, e.g. more than around 3.1 mm, e.g. more than around 3.2 mm, e.g. more than around 3.3 mm, e.g. more than around 3.4 mm and/or the wick material may have a characteristic diameter of less than around 4.5 mm, e.g. less than around 4.4 mm, e.g. less than around 4.3 mm, e.g. less than around 4.2 mm, e.g. less than around 4.1 mm, e.g. less than around 4.0 mm, e.g. less than around 3.9 mm, e.g. less than around 3.8 mm, e.g. less than around 3.7 mm, e.g. less than around 3.6 mm. An acceptable tolerance for the parameters of the wick material will depend on the implementation at hand. In this example it is assumed an acceptable tolerance for the linear mass of the wick material is around +/−10% and an acceptable tolerance for characteristic diameter of the wick material is around +1 mm/−0.5 mm. More generally, the manufacturing method for the wick material may involve controlling the wick material diameter to meet a target diameter within a tolerance of +5%/−2.5% of the target diameter.

In terms of cross-sectional area in a plane perpendicular to the axis of extent for the wick material (i.e. in the plane of the smallest cross section), these example ranges of wick material diameter correspond with a wick material having may have an areal cross section of more than 5.7 $mm^2$, e.g. more than around 6.2 $mm^2$, e.g. more than around 6.6 $mm^2$, e.g. more than around 7.1 $mm^2$, e.g. more than around 7.5 $mm^2$, e.g. more than around 8.0 $mm^2$, e.g. more than around 8.6 $mm^2$, e.g. more than around 9.1 $mm^2$ and/or the wick material may have an areal cross section of less than 15.9 $mm^2$, e.g. less than around 15.2 $mm^2$, e.g. less than around 14.5 $mm^2$, e.g. less than around 13.9 $mm^2$, e.g. less than around 13.2 $mm^2$, e.g. less than around 12.6 $mm^2$, e.g. less than around 11.9 $mm^2$, e.g. less than around 11.3 $mm^2$, e.g. less than around 10.8 $mm^2$, e.g. less than around 10.2 $mm^2$.

Once the wick material has been formed by twisting a pair of cotton threads as discussed above with reference to S7, it may in some examples be subject to quality control monitoring/testing as schematically indicated in S8. There are various different tests that may be adopted for quality control purposes, and the tests may be applied for all the wicking material (for example tests relating to visual appearance) or selected samples of the material (for example for destructive tests) in accordance with the established principles of batch testing of a production process. For example, and as indicted in S8, there may in some examples be a requirement for one or more of the following: (i) the wick material should be white and without foreign particles (e.g. to test for contamination); (ii) a sample of wick material, e.g. 5 g, should sink in water within a given time, e.g. 10 seconds (e.g. to test absorptivity); (iii) a sample should have a breaking tension of around 0.3 (+/−0.1) kgf (e.g. to test strength); (iv) the average fiber length should be around 31 mm (this may be tested, for example, using a capacitive length tester apparatus).

In S9, assuming the current batch of wick material passes the quality control testing in S8, the wick material is formed into rolls for storage and/or further handling. In this example it is assumed each roll comprises 1 (+/−10%) kg of wick material. However, it will be appreciated the roll size may be different in different implementations, for example having regard to the scale on which the wick material is to be processed to form vaporizer assemblies.

In the example processing represented in FIG. 4 it is assumed the wick material is stored before any further processing (i.e. before being incorporated into vaporizer assemblies), and as indicated in S10, in accordance with the method proposed herein, the wick material stored in food grade bags under 40% to 70% humidity.

Thus, FIG. 4 schematically represents an approach for forming wick material for use in a vaporizer assembly of an electronic cigarette in accordance with certain embodiments of the disclosure, for example for use in the electronic cigarette 1 represented in FIGS. 1 and 2. It will be appreciated method represented in FIG. 4 is merely one specific example, and modifications to this approach may be adopted in accordance with other embodiments of the disclosure. For example, some of the steps represented in FIG. 4 may be omitted in some example implementations. For example, a quality control testing along the lines represented in FIG. 4 in S8 may not be implemented in some examples. Furthermore, and as already noted above, it will be appreciated the specific example parameters represented in FIG. 4 are indicative of suitable values for one implementation provided by way of a concrete example, and different specific values may be used in other implementations. It will be appreciated various steps of the method set out above in relation to FIG. 4 may be formed manually or automatically with an appropriately configured machine.

Figure 5:
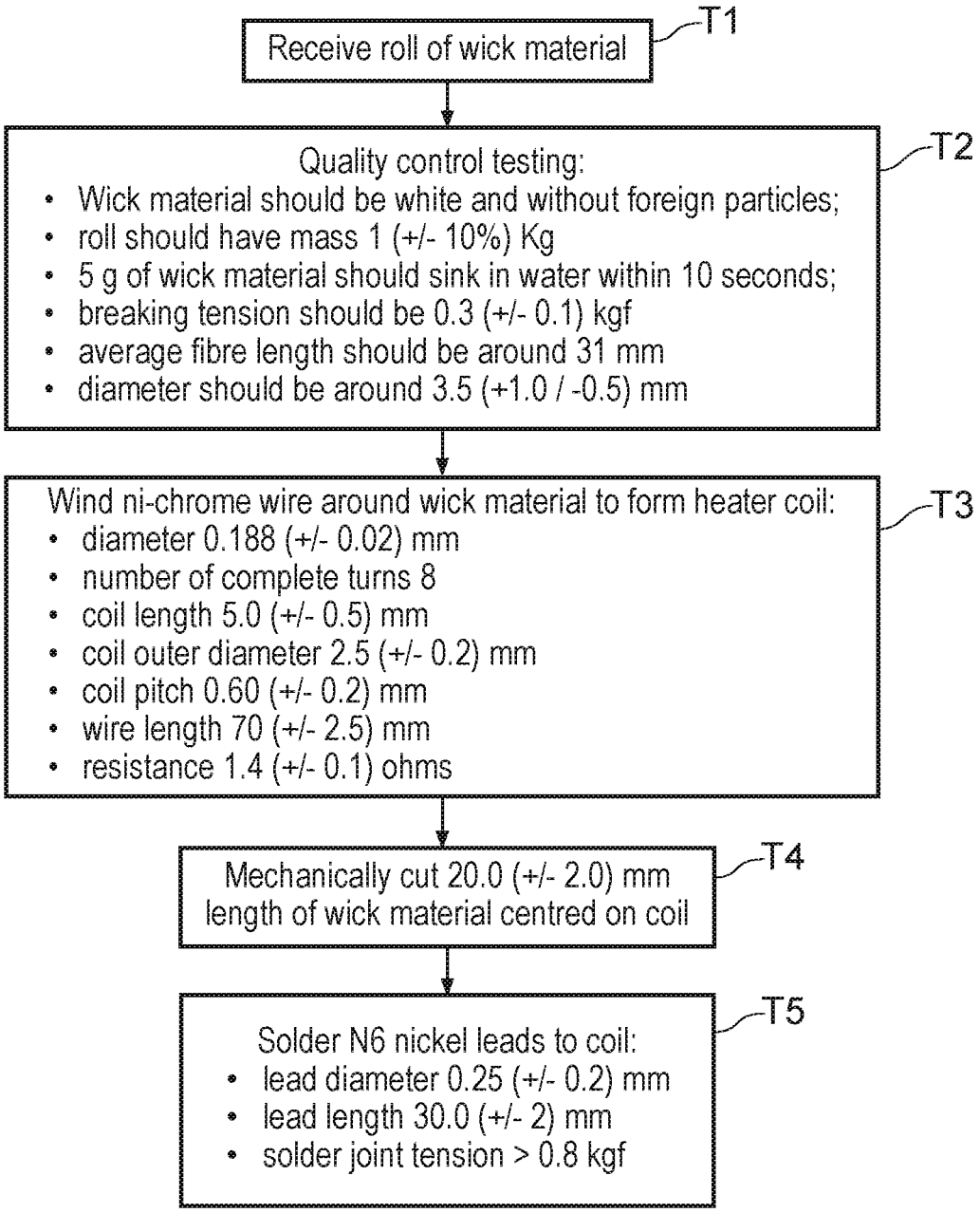
FIG. 5 is a flow diagram schematically representing steps in a method of forming a vaporizer assembly for use in a vapor provision system according to an embodiment of the disclosure.

FIG. 5 is flow diagram schematically representing a method for forming a vaporizer assembly for a vapor provision system in accordance with certain embodiments of the disclosure, for example the vaporizer assembly 36 discussed above, using wick material manufactured in accordance with the principles represented in FIG. 4. However, it will be appreciated in other example the principles represented in FIG. 5 may be applied to form a vaporizer with a liquid transport element which is not made in accordance with the principles set out in FIG. 4.

Processing starts in T1 with a roll of wick material derived from the processing of FIG. 4 (the wick material having been removed from any storage bag/container).

In T2 the roll of wick material is subject to quality control testing. There are various different tests that may be adopted for quality control purposes, some of which may correspond with the quality control testing approaches discussed above with reference to S8 in FIG. 4. Tests may be applied for roll of wicking material as a whole (for example tests relating to visual appearance) or for samples of the material (for example for destructive tests) in accordance with the established principles of product batch testing. For example, and as indicted in T2, there may in some examples be a requirement for one or more of the following: (i) the wick material should be white and without foreign particles (e.g. to test for contamination); (ii) the roll of wick material should have a mass of 1 (+/−10%) kg; (iii) a sample of wick material, e.g. 5 g, should sink in water within a given time, e.g. 10 seconds (e.g. to test absorptivity); (iv) a sample should have a breaking tension of around 0.3 (+/−0.1) kgf (e.g. to test strength); (v) the average fiber length should be around 31 mm (this may be tested, for example, using a capacitive length tester apparatus); (vi) the of the wick material should be around 3.5 (+1.0/−0.5) mm. It will of course be appreciated these specific quality control parameters are based on these desired characteristics for the wick material as discussed above in relation to the manufacturing process of FIG. 4. In other example implementations the wick material may have different target values for these parameters, as discussed above, and in which case the quality control testing will be modified accordingly.

In T3 a section of heater wire is wound around the wick material to form a heater coil. As noted above, in this example the heater wire comprises a nickel chrome (NiChrome) alloy, for example an 80:20 Ni:Cr alloy. However, it will be appreciated in other examples different materials may be used, for example other electrically resistive wires of the kind previously used in electronic cigarettes. In other example the heater might not comprise a coil, but may, for example, comprise a tubular collar having a similar overall size to the coil in this example.

In this example the wire has a diameter of around 0.188 (+/−0.020) mm and is formed into a coil around the wick material having an outer diameter of around 2.5 (+/−0.2) mm and an average pitch of around 0.60 (+/−0.2) mm. The coil in this example comprises eight complete turns (i.e. a total of 8.5 rotations of the wire about the wick material) and the length of the coil around the wicking material is around 5.0 (+/−0.5) mm. The total length of the wire forming the coil is around 70 (+/−2.5) mm. The wire comprising the coil in this example has an electrical resistance of 1.4 (+/−0.1) ohms. In the examples discussed herein, references to the resistance of a heater coil are to be taken to refer to the measured the resistance when the coil is cold—i.e. not when it is being heated to generate vapor, when its resistance will be a little higher than when cold. It will be appreciated these various characteristics of the coil examples of one specific implementation, and in other examples different values for these characteristics may be adopted.

In some cases the diameter of the heating wire may be more than around 0.15 mm, e.g. more than around 0.16 mm, e.g. more than around 0.17 mm, e.g. more than around 0.18 mm, and/or the diameter of the heating wire may be less than around 0.23 mm, e.g. less than around 0.22 mm, e.g. less than around 0.21 mm, e.g. less than around 0.19 mm.

In some cases the coil formed from the heating wire may have an outer diameter which is more than around 2.0 mm, e.g. more than around 2.1 mm, e.g. more than around 2.2 mm, e.g. more than around 2.3 mm, e.g. more than around 2.4 mm, and/or the coil formed from the heating wire may have an outer diameter which is less than around 3.0 mm, e.g. less than around 2.9 mm, e.g. less than around 2.8 mm, e.g. less than around 2.7 mm, e.g. less than around 2.6 mm.

In terms of an inner diameter for the coil (corresponding to the outer diameter of the portion of the wick compressed by the heating element), in some examples the coil formed from the heating wire may have an inner diameter which is e.g. more than around 1.6 mm, e.g. more than around 1.7 mm, e.g. more than around 1.8 mm, e.g. more than around 1.9 mm, e.g. more than around 2.0 mm, and/or the coil formed from the heating wire may have an inner diameter which is e.g. less than around 2.6 mm, e.g. less than around 2.5 mm, e.g. less than around 2.4 mm, e.g. less than around 2.3 mm, e.g. less than around 2.1 mm.

In some cases the coil formed from the heating wire may have pitch which is more than around 0.4 mm, e.g. more than around 0.45 mm, e.g. more than around 0.5 mm, e.g. more than around 0.55 mm, and/or the coil formed from the heating wire may have a pitch which is less than around 0.85 mm, e.g. less than around 0.8 mm, e.g. less than around 0.75 mm, e.g. less than around 0.7 mm, e.g. less than around 0.65 mm.

In some cases the coil may comprise more than 5 complete turns of wire around the wick material, more than 6 complete turns of wire around the wick material, or more than 7 complete turns of wire around the wick material, and/or less than 10 complete turns of wire around the wick material, less 11 complete turns of wire around the wick material or less than 12 complete turns of wire around the wick material. In some examples the coil may comprise 8 or 9 complete turns of wire around the wick material.

In some cases the coil formed from the heating wire may extend along the wicking material by more than around 3 mm, e.g. more than around 3.5 mm, e.g. more than around 4 mm, e.g. more than around 4.5 mm, and/or the coil formed from the heating wire may extend along the wicking material by less than around 8 mm, e.g. less than around 7.5 mm, e.g. less than around 7 mm, e.g. less than around 6.5 mm, e.g. less than around 6 mm, e.g. less than around 5.5 mm.

In some examples a coil comprising the heating wire may have an electrical resistance of more than around 1.3 ohms, e.g. more than around 1.32 ohms, e.g. more than around 1.34 ohms, e.g. more than around 1.36 ohms, e.g. more than around 1.38 ohms, and/or the wire comprising the coil may have an electrical resistance of less than around less than around 1.5 ohms, e.g. less than around 1.48 ohms, e.g. less than around 1.46 ohms, e.g. less than around 1.44 ohms, e.g. less than around 1.42 ohms. In this regard it will be appreciated as a practical matter the example resistances discussed herein may be measured directly across the ends of the resistance wire itself, or may be measured between points on the connection leads that connect to the heater coil to its power supply since the additional resistance of the connection leads themselves will be minimal compared to the resistance of the heater coil. For example, one convenient way to measure heater resistance in an assembled vapor provision system of the kind represented in FIGS. 1 and 2 might be to measure resistance between the electrical connectors 46 providing the electrical interface for the cartridge part, whereas during assembly, the resistance may instead be measured between points on the respective connection leads 41, for example. Of course it will be appreciated there would be no need to measure the resistance of individual vaporizer assemblies during manufacture to establish their resistance since the coil resistance is governed by the wire material and geometry (i.e. length and thickness). Thus, once a particular coil material and geometry is known to provide the desired resistance, coils made to this design can be assumed to have the desired resistance without needing to actually measure it.

It will be appreciated for the example parameters set out above the wicking material is compressed by the heater wire wrapped around the wick material form the coil. In particular, in this example the diameter of the wick material within the coil is compressed from its initially manufactured diameter (rest diameter) of around 3.5 mm down to a diameter of around 2.1 mm (since the coil is formed with an outer diameter of around 2.5 mm and a wire thickness of a little under 0.2 mm). Thus, in this example the diameter of the wick material is compressed by the coil to approximately 60% of its rest state diameter. That is to say, the diameter of the wick material is compressed by around 40% by the coil wrapped around the wick material. This corresponds with a reduction in cross-sectional area the wick within the coil of around 64% (i.e. from around 9.6 $mm^2$ before compression to around 3.5 $mm^2$ after compression by the coil). The inventors have identified this kind of compression of the wick by the coil can provide a vaporizer assembly having overall improved performance relative to existing approaches, for example in terms of the amount of vapor produced and reduced likelihood of undesirable tastes from overheating. It will be appreciated different amounts of compression may be adopted in different example implementations. For example, in some cases the diameter of the wick material may be compressed by the heating coil by an amount which is more than around 20%, e.g. more than around 25%, e.g. more than around 30%, e.g. more than around 35%, and/or the diameter of the wick material may be compressed by the heating coil by an amount which is less than around 60%, e.g. less than around 55%, e.g. less than around 50%, e.g. less than around 45%.

As noted above, a characteristic diameter of a liquid transport element having a non-circular cross-section may be defied by reference to the diameter of a circle having the same area as the cross-section of the liquid transport element. In that regard, amounts by which the wick material is compressed by the heater may also be defined by reference to the reduction in cross-sectional area of the wick material (in a plane perpendicular to its axis of longest extent) caused by the heater coil. Thus, in some examples the cross-section of the wick material may be compressed by the coil by around 65% (e.g. from around 3.5 mm diameter to 2.1 mm diameter, as in the specific example discussed above). More generally, in accordance with some implementations the cross-sectional area of the wick material may be compressed by the heating coil by more than around 25%, e.g. more than around 30%, e.g. more than around 35%, e.g. more than around 40%, e.g. more than around 45%, e.g. more than around 50%, e.g. more than around 55%, e.g. more than around 60%, and/or the cross-sectional area of the wick material may be compressed by the heating coil by an amount which is less than around 90%, e.g. less than around 85%, e.g. less than around 80%, e.g. less than around 75%, e.g. less than around 70%. It will be appreciated in this context compression of the wick material area by X % is intended to indicate the cross-sectional area of the wick material after compression is X % of the cross-sectional area of the wick material before compression/where it is not compressed.

In T4 a section of the wick material having a length of around 20 (+/−2) mm and centered around the coil is cut from the wick material, e.g. using a mechanical cutter. The cut length of the wick material provides the liquid transport element (wick) for a vapor provision system in accordance with certain embodiments of the disclosure. In this regard, the specific length of wick material which is cut in T4 may be selected having regard to the desired length of the liquid transport element for the electronic cigarette configuration at hand. Thus, whereas in this example a length of around 20 mm is cut from the wick material, in other examples the wick material may be cut to a different length. For example, in some cases the cut length of wick material may be more than around 10 mm, e.g. more than around 12 mm, e.g. more than around 14 mm, e.g. more than around 16 mm, e.g. more than around 18 mm, and/or the cut length of wick material may be less than around 30 mm, e.g. less than around 28 mm, e.g. less than around 26 mm, e.g. less than around 24 mm, e.g. less than around 22 mm.

In T5 connection leads are soldered to the ends of the wire comprising coil. In this example the respective connection leads comprise N6 nickel wire with a diameter of around 0.25 (+/−0.2) mm and a length of around 30 (+/−2) mm. The connection leads are soldered to the coil in accordance with conventional soldering techniques, for example to provide a soldered joint tension of greater than 0.8 kgf. It will be appreciated in other examples of different connection means may be adopted several soldering, for example welding or mechanical clamping. Furthermore, it will be appreciated in other examples material, length and diameter of the election the wire may be different.

In some examples the connection lead wire diameter may be more than around 0.15 mm, e.g. more than around 0.17 mm, e.g. more than around 0.19 mm, e.g. more than around 0.21 mm, e.g. more than around 0.23 mm and/or the connection lead wire diameter may be less than around 0.35 mm, e.g. less than around 0.31 mm, e.g. less than around 0.29 mm, e.g. less than around 0.27 mm.

In some examples the connection lead wire length may be more than around 15 mm, e.g. more than around 20 mm, e.g. more than around 25 mm, and/or the connection lead wire length may be less than around 50 mm, e.g. less than around 45 mm, e.g. less than around 40 mm, e.g. less than around 35 mm.

Thus, FIG. 5 schematically represents an approach for forming a vaporizer assembly for use in an electronic cigarette in accordance with certain embodiments of the disclosure, for example for use in the electronic cigarette 1 represented in FIGS. 1 and 2. It will be appreciated method represented in FIG. 5 is merely one specific example, and modifications to this approach may be adopted in accordance with other embodiments of the disclosure. For example, some of the steps represented in FIG. 5 may be omitted in some example implementations or performed in a different order. For example, a quality control testing step along the lines represented in FIG. 5 in T2 may not be implemented in some examples. Furthermore, in some cases the wick material may be cut to length (T4) before the coil is wound around the wick material (T3), and the connection leads may be soldered to the coil (T5) before the wick material is cut to length (T4) and/or the coil is wound around the wick material (T6). Furthermore, and as already noted above, it will be appreciated the specific example parameters represented in FIG. 5 are indicative of suitable values for one implementation provided by way of a concrete example, and different specific values may be used in other implementations. It will be appreciated various steps of the method set out above in relation to FIG. 5 may be formed manually or automatically with an appropriately configured machine.

Figure 6:
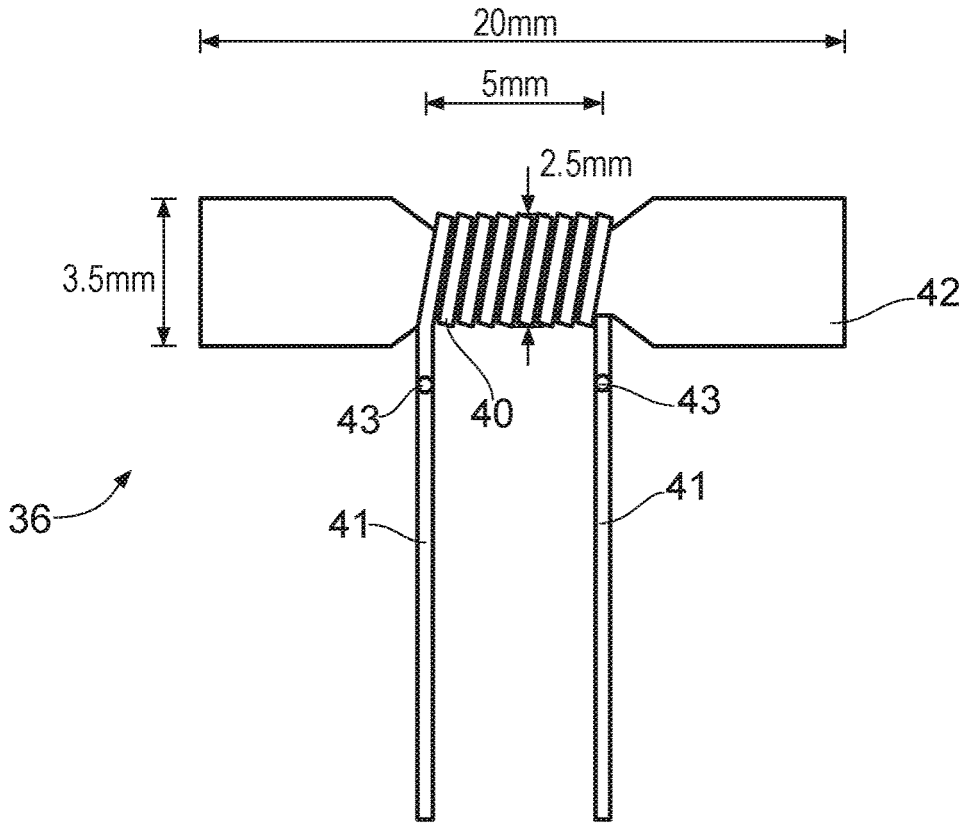
FIG. 6 schematically represents a vaporizer assembly according to an embodiment of the disclosure.

FIG. 6 schematically represents a side view (not to scale) of the vaporizer assembly 36 of the electronic cigarette represented in FIGS. 1 and 2 manufactured in accordance with the principles set out in FIG. 5.

Figure 7:
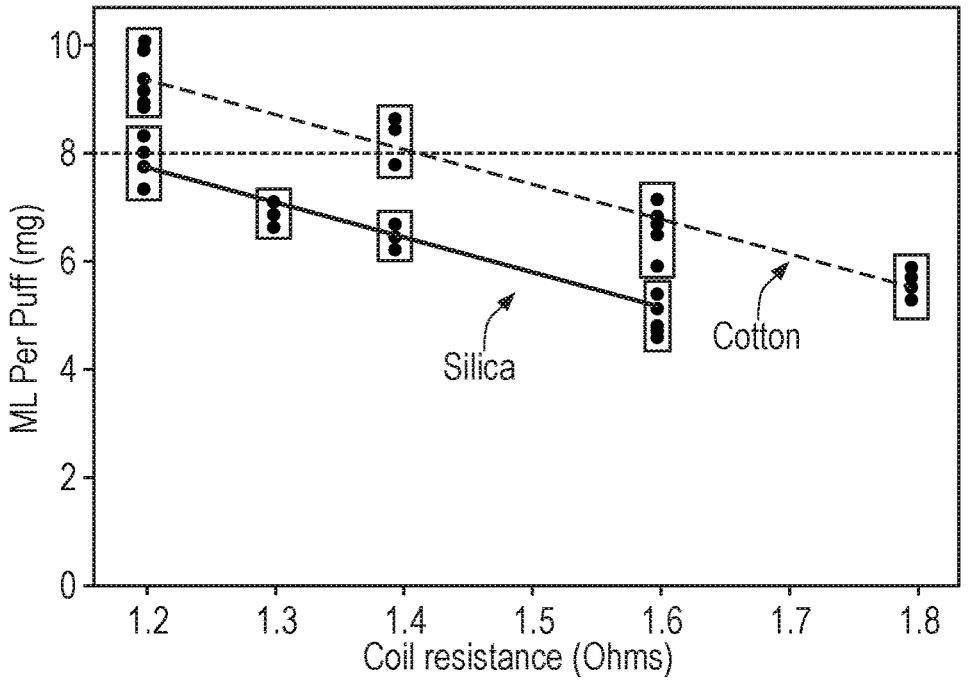
FIG. 7 is a graph schematically representing the amount of vapor generated by a vapor provision system of the kind represented in FIGS. 1 and 2 for different wick materials and various different coil resistances.

FIG. 7 is a graph schematically representing the amount of vapor generated by a vapor provision system having the overall structure represented in FIGS. 1 and 2, but for different vaporizer assemblies comprising different combinations of wick material and heater coil resistance. The amount of vapor generated by the vapor provision system is characterized by the mass loss (ML) per puff in milligrams. This corresponds with the measured reduction in mass for the vapor provision system that results from a machine puff having fixed characteristics (e.g. in terms of draw strength and duration) and with a fixed voltage applied to the heater coil. In terms of user satisfaction, a mass loss per puff of 8 mg is considered a good target.

FIG. 7 shows results for two types of wick material, namely a silica glass fiber wick (data points grouped around the solid fitted line) and a cotton wick of the kind discussed above and manufactured in accordance with the principles set out with reference to FIGS. 4 and 5 (data points grouped around the dashed fitted line). Apart from the difference in composition, the different wicks have the same configuration in terms of their geometry. For each wick material results are shown for different heater coil resistances. In particular, FIG. 7 shows results for 8 different combinations of wick material and coil resistance, namely coil resistance of 1.2 ohms, 1.3 ohms, 1.4 ohms and 1.6 ohms for a silica wick and coil resistance of 1.2 ohms, 1.4 ohms, 1.6 ohms and 1.8 ohms for a cotton wick. A plurality of measurements of mass loss per puff measured for each combination of wick material and resistance is shown in FIG. 7. Because the different measurements are made with the same voltage applied to the heater coils, a higher coil resistance is associated with lower power (and hence energy used) for each puff. This is apparent from the general downward trend in mass loss with increasing resistance with both types of wick showing a broadly linear relationship between coil resistance and mass loss.

FIG. 7 demonstrates that using a cotton wick can provide consistently higher mass loss per puff as compared to using a silica wick for the different resistances in FIG. 7. In particular, the results demonstrate using a cotton wick delivers approximately 2 mg more vapor per puff (i.e. the device loses approximately 2 mg more per puff) as compared to using an equivalent silica wick. This indicates cotton is a more efficient wicking material than silica. For example, to achieve a target mass loss per path of 8 mg, a coil resistance of around 1.4 ohms may be used for a cotton wick, whereas a coil resistance of around 1.2 ohms is needed for a silica wick. This indicates that using a cotton wick and a coil resistance of around 1.4 ohms can help provide a desired target mass loss per puff with less power/energy than would be needed for corresponding performance using a silica wick (since this would require a lower resistance heater coil giving rise to higher current draw).

The following table (Table 1) sets out the mean values of mass loss (in units of milligrams per standardized puff) for the different combinations of wick material and coil resistance shown in FIG. 7. For the combination of a silica wick and a 1.6 ohm heater there are two values provided in the table, and these correspond to two different configurations of vapor provision system used for this combination.

TABLE 1

| Wick material | Heater resistance (ohms) | Mean mass loss (mg) per puff |
|---|---|---|
| Silica | 1.2 | 7.96 |
| Silica | 1.3 | 6.99 |
| Silica | 1.4 | 6.55 |
| Silica | 1.6 | 4.94/5.29 |
| Cotton | 1.2 | 9.57 |
| Cotton | 1.4 | 8.31 |
| Cotton | 1.6 | 6.65 |
| Cotton | 1.8 | 5.61 |

Thus, a combination of a cotton wick and a 1.4 ohm heater coil resistance (as in the specific example implementations discussed above with reference to FIGS. 5 and 6) can provide a desired performance, in terms of vapor generation, using less power than approaches based on a silica wick. It will of course be appreciated the resistance in a specific implementation need not be exactly 1.4 ohms, and different heater resistances may be used in different implementations, the example in cases where there is a desire for a slightly higher or lower performance in terms of mass loss per puff, for example, coil resistances in the range 1.3 to 1.5 ohms all provide acceptable performances when used in conjunction with a cotton wick.

Another important performance characteristic for vapor provision systems is the extent to which source liquid material is heated to undesirable temperatures, which can give rise burning tastes. One way of characterizing this is to measure the amount of carbonyl emissions from an electronic cigarette, e.g. by measuring the amount of formaldehyde generation during use.

The following table (Table 2) sets out measurements of mean formaldehyde emissions (in units of micrograms per day) for a number of samples (typically five or six) of the different combinations of wick material discussed above). For the combination of a silica wick and a 1.6 ohm heater there are two values provided in the table, and these correspond to two different configurations of vapor provision system.

TABLE 2

| Wick material | Heater resistance (ohms) | Mean formaldehyde emissions (microgram per day) |
|---|---|---|
| Silica | 1.2 | 242 |
| Silica | 1.3 | 260 |
| Silica | 1.4 | 927 |
| Silica | 1.6 | 370/1288 |
| Cotton | 1.2 | 68 |
| Cotton | 1.4 | 105 |
| Cotton | 1.6 | 53 |
| Cotton | 1.8 | 89 |

This table demonstrates using a cotton wick is associated with lower formaldehyde emissions as compared to using a silica wick across the range of coil resistances considered here.

Yet another performance characteristic for electronic cigarettes is the likelihood of leakage during storage and use. Testing of the different combinations of wick material and heater coil resistance discussed above used in the vapor provision system configurations represented in FIGS. 1 and 2 shows that none of the combinations suffer from measurable leakage during storage, or in normal use, or when being tapped. However, it was noticed that all the silica wick combinations suffered some degree of leakage during shipment, for example around 2% of silica wick samples suffered notable leakage during shipment. The performance of the cotton wick combinations performed mostly better with only around 0.3% of cotton wick samples suffering notable leakage during shipment. This would appear to indicate the cotton wick material is better at forming a seal where the wick passes through the with the air channel wall compared to the silica wick material.

Thus, having regard to the performance characteristics seen for different combinations of wick material and coil resistance, it is apparent using a cotton wick and a coil resistance in the range 1.3 ohms to 1.5 ohms can in some respects be considered an optimized combination of wick material and heater resistance for use in an electronic cigarette, for example an electronic cigarette of the kind represented in FIGS. 1 and 2.

It will be appreciated that while the above description has focused on some different aspects of liquid transport elements and/or heaters having a number of different features, it will be appreciated arrangements in accordance with other embodiments of the disclosure may include only some of these features independently of some of the other features. For example, in some implementations a wick made in accordance with the principles discussed herein with reference to FIG. 5 may be implemented in a vaporizer assembly does not include a coil wound around the wick to compress the wick as represented in FIG. 6. Similarly, for a vaporizer assembly comprising a cotton wick and a heater coil having a resistance selected according to the principles discussed herein, the wick need not necessarily be made or have a form in accordance with the approaches discussed above with reference to FIG. 4, 5 or 6. What is more, in a vaporizer assembly comprising a heating coil wound around a wick to compress the wick according to the principles discussed herein, for example as represented in FIG. 6, the wick might not necessarily comprise a cotton wick manufactured in the manner disclosed herein with reference to FIG. 4, but may comprise a cotton wick manufactured using a different process and/or another material, e.g. another fibrous material such as glass fiber.

Thus, there has been described a method of manufacturing wick material for use as a liquid transport element in a vapor provision system, the method comprising: providing at least two cotton threads; and twisting the cotton threads together to form the wick material such that that the wick material consists of two or more cotton threads.

There has also been described a vaporizer assembly for use in a vapor provision system, wherein the vaporizer assembly comprises a liquid transport element having a heater-wrapped portion and a non-heater-wrapped portion and a heating element wrapped around the heater-wrapped portion; wherein the heater-wrapped portion of the liquid transport element is compressed by the heating element so its cross-sectional area is reduced by more than 25% compared to the non-heater-wrapped portion.

There has also been described a vaporizer assembly for use in a vapor provision system, wherein the vaporizer assembly comprises: a liquid transport element formed from cotton; and a heating coil arranged around a portion of the liquid transport element, wherein the heating coil has an electrical resistance of between 1.3 ohms and 1.5 ohms.

While the above described embodiments have in some respects focused on some specific example vapor provision systems, it will be appreciated the same principles can be applied for vapor provision systems using other technologies. That is to say, the specific manner in which various aspects of the vapor provision system function, for example in terms of how the system is activated for use and the functionality provided by the system, are not directly relevant to the principles underlying the examples described herein.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. A vaporizer assembly for use in a vapor provision system, wherein the vaporizer assembly comprises:

a liquid transport element formed from cotton; and a heating element comprising a coil of resistive wire around a portion of the liquid transport element, wherein the heating element has an electrical resistance of between 1.3 ohms and 1.5 ohms, wherein the portion of the liquid transport element within the coil is compressed by the coil so a cross-sectional area of the portion of the liquid transport element is reduced by more than 25% compared to a cross-sectional area of an uncompressed liquid transport element.

2. The vaporizer assembly of claim 1, wherein the heating element has an electrical resistance selected from the group consisting of: more than 1.32 ohms, more than 1.34 ohms, more than 1.36 ohms, and more than 1.38 ohms.

3. The vaporizer assembly of claim 1, wherein the heating element has an electrical resistance selected from the group consisting of: less than 1.5 ohms, less than 1.48 ohms, less than 1.46 ohms, less than 1.44 ohms, and less than 1.42 ohms.

4. The vaporizer assembly of claim 1, wherein:

the coil has an outer diameter selected from the group consisting of: more than 2.0 mm, more than 2.1 mm, more than 2.2 mm, more than 2.3 mm, more than 2.4 mm, less than 3.0 mm, less than 2.9 mm, less than 2.8 mm, less than 2.7 mm, and less than 2.6 mm.

5. The vaporizer assembly of claim 1, wherein:

the heating element extends along the liquid transport element for a distance selected from the group consisting of: more than 3 mm, more than 3.5 mm, more than 4 mm, more than 4.5 mm, less than 8 mm, less than 7.5 mm, less than 7 mm, less than 6.5 mm, less than 6 mm, and less than 5.5 mm.

6. The vaporizer assembly of claim 1, wherein:

the liquid transport element has a length selected from the group consisting of: more than 10 mm, more than 12 mm, more than 14 mm, more than 16 mm, more than 18 mm, less than 30 mm, less than 28 mm, less than 26 mm, less than 24 mm, and less than 22 mm.

7. The vaporizer assembly of claim 1, wherein:

the resistive wire comprising the coil has a diameter selected from the group consisting of: more than 0.15 mm, more than 0.16 mm, more than 0.17 mm, more than 0.18 mm, less than 0.23 mm, less than 0.22 mm, less than 0.21 mm, and less than 0.19 mm.

8. The vaporizer assembly of claim 1, wherein the coil comprises between 6 and 12 complete turns around the liquid transport element.

9. The vaporizer assembly of claim 1, wherein:

the coil has a pitch selected from the group consisting of: more than 0.45 mm, more than 0.45 mm, more than 0.5 mm, more than 0.55 mm, less than 0.85 mm, less than 0.8 mm, less than 0.75 mm, less than 0.7 mm, and less than 0.65 mm.

10. The vaporizer assembly of claim 1, further comprising first and second connection leads electrically connected to the coil.

11. The vaporizer assembly of claim 1, wherein the liquid transport element comprises a cotton thread.

12. The vaporizer assembly of claim 11, wherein the liquid transport element comprises two or more cotton threads twisted together.

13. A vaporizer assembly, for use in a vapor provision system, wherein the vaporizer assembly comprises:

a liquid transport element formed from cotton; and a heating element comprising a coil of resistive wire around a portion of the liquid transport element, wherein the heating element has an electrical resistance of between 1.3 ohms and 1.5 ohms, wherein the liquid transport element has an uncompressed diameter selected from the group consisting of: more than 2.7 mm, more than 2.8 mm, more than 2.9 mm, more than 3.0 mm, more than 3.1 mm, more than 3.2 mm, more than 3.3 mm, and more than 3.4 mm.

14. A vaporizer assembly, for use in a vapor provision system, wherein the vaporizer assembly comprises:

a liquid transport element formed from cotton; and a heating element comprising a coil of resistive wire around a portion of the liquid transport element, wherein the heating element has an electrical resistance of between 1.3 ohms and 1.5 ohms, wherein the liquid transport element has an uncompressed diameter selected from the group consisting of: less than 4.5 mm, less than 4.4 mm, less than 4.3 mm, less than 4.2 mm, less than 4.1 mm, less than 4.0 mm, less than 3.9 mm, less than 3.8 mm, less than 3.7 mm, and less than 3.6 mm.

15. The vaporizer assembly of claim 1, wherein the cotton comprising the liquid transport element comprises fibers having an average length selected from the group consisting of: more than 15 mm, more than 20 mm, more than 25 mm, and more than 30 mm.

16. The vaporizer assembly of claim 1, wherein the liquid transport element has a linear mass selected from the group consisting of: more than 0.5 g/m, more than 0.6 g/m, more than 0.7 g/m, more than 0.8 g/m, more than 0.9 g/m, more than 1.0 g/m, more than 1.1 g/m, more than 1.2 g/m, and more than 1.3 g/m.

17. The vaporizer assembly of claim 1, wherein the liquid transport element has a linear mass selected from the group consisting of: less than 2.5 g/m, less than 2.4 g/m, less than 2.3 g/m, less than 2.2 g/m, less than 2.1 g/m, less than 2.0 g/m, less than 1.9 g/m, less than 1.8 g/m, less than 1.7 g/m, less than 1.6 g/m, and less than 1.5 g/m.

18. An apparatus comprising:

the vaporizer assembly of claim 1; and a reservoir for source liquid, wherein the liquid transport element is arranged to draw source liquid from the reservoir to the heating element for heating to generate vapor for user inhalation.

19. The apparatus of claim 18, wherein the apparatus is a cartridge for use in a vapor provision system.

20. The apparatus of claim 18, wherein the apparatus is a vapor provision system and further comprises a controller and a battery, wherein the controller is configured to selectively control a supply of power from the battery to the vaporizer assembly.

21. Vaporizer assembly means for use in a vapor provision means, wherein the vaporizer assembly means comprises:

liquid transport means formed from cotton; and heating element means comprising a coil of resistive wire around a portion of the liquid transport means, wherein the heating element means has an electrical resistance of between 1.3 ohms and 1.5 ohms, wherein the portion of the liquid transport element within the coil is compressed by the coil so a cross-sectional area of the portion of the liquid transport element is reduced by more than 25% compared to a cross-sectional area of an uncompressed liquid transport element.

22. A method of manufacturing a vaporizer assembly for use in a vapor provision system, wherein the method comprises:

providing a liquid transport element; and forming a heating element comprising a coil of resistive wire around a portion of the liquid transport element, wherein the heating element has an electrical resistance of between 1.3 ohms and 1.5 ohms, wherein a portion of the liquid transport element within the coil is compressed by the coil so a cross-sectional area of the portion of the liquid transport element is reduced by more than 25% compared to a cross-sectional area of an uncompressed liquid transport element.

* * * * *